United States Patent [19]

Deltour

[11] 3,983,684

[45] Oct. 5, 1976

[54] TEXTURED THREAD AND PROCESS FOR OBTAINING THE SAME

[75] Inventor: Jean Deltour, Pont De Cherry, France

[73] Assignee: Chavanoz S.A., Chavanoz, France

[22] Filed: Jan. 22, 1973

[21] Appl. No.: 325,778

[30] Foreign Application Priority Data

Jan. 28, 1972 France ..... 72.03401

[52] U.S. Cl. ..... 57/140 J; 57/157 TS

[51] Int. Cl.[2] ..... D02G 1/02; D02G 3/34

[58] Field of Search ..... 57/140 R, 140 J, 157 TS

[56] References Cited

UNITED STATES PATENTS

| | | | |
|---|---|---|---|
| 3,587,221 | 6/1971 | Buzano | 57/140 J |
| 3,630,013 | 12/1971 | Buzano | 57/140 R |
| 3,680,301 | 8/1972 | Buzano | 57/140 J |
| 3,691,748 | 9/1972 | Buzano | 57/140 J |

*Primary Examiner*—Jerry W. Myracle
*Assistant Examiner*—Charles Gorenstein
*Attorney, Agent, or Firm*—Earle R. Marden; H. William Petry

[57] ABSTRACT

The invention relates to a new highly elastic textured thread obtained by a process which consists in treating by false twisting a synthetic thread previously drawn in a cracking bath, the process being characterized in that, on the one hand, the level of the twist imparted temporarily to the thread during the treatment of false twist is much higher than that usually imparted, and that, on the other hand, the heat treatment in the supertwisted state is carried out at a temperature higher than that utilized for threads obtained according to French Pat. No. 1,587,619, but lower than the usual temperature utilized for threads of the same chemical nature but not drawn in a cracking bath.

2 Claims, No Drawings

TEXTURED THREAD AND PROCESS FOR OBTAINING THE SAME

The present invention relates to a new elastic, textured thread, with large apparent volume and helical, three-dimensional curl. It also relates to a process for obtaining such a thread.

Previous French Pat. Nos. 1,583,695, 1,583,696 and 1,583,697, which correspond to U.S. Pat. Nos. 3,691,748, 3,680,301 and 3,587,221, respectively, describe the obtaining of new threads formed of continuous filaments of synthetic, thermoplastic material, each filament comprising, on the microscopic scale, alternating zones the diameter of which increases and decreases gradually between at least two different mean values, and in which the zones of smaller diameter correspond to the zones having a higher index of crystallinity and superior molecular orientation, each filament having a large apparent volume.

For the sake of simplicity in the remainder of the description, such threads will be designated by the expression "threads drawn previously in contact with a cracking bath." In addition, the term "false twist" will be used to designate an operation which consists in twisting, hot-fixing, cooling, then untwisting a continuous thermoplastic thread, these operations optionally being carried out continuously or discontinuously. In the latter case will be used, for example, a spindle equipped with a twist blocking member, a friction spindle or any other equivalent device. Finally, the term "standard thread" will be used to designate a thread of the same chemical nature but with filaments which are uniform in section throughout their length.

Moreover, French Pat. No. 1,587,619 which corresponds to U.S. Pat. No. 3,630,013 describes a new type of thread with three-dimensional curl, obtained by treatment by false twist of a synthetic, thermoplastic thread, drawn previously in contact with a cracking agent. Generally the cracking agents which may be employed are the lower alcohols and the cracking bath may be an aqueous solution containing the lower alcohols. The false twist treatment of such threads is carried out at a temperature in the twist fixing zone which is substantially below the temperature usually employed: a temperature comprised between 100°C. and 150°C., instead of about 200° C. to 220° C. for threads with polyethylene terephthalate base, the threads having good elasticity and a good swelling.

We have found, that this forms the object of the present invention, a thermoplastic synthetic thread with three-dimensional curl, which possesses higher properties of elasticity while retaining good mechanical strength, the said thread having been previously drawn in contact with a cracking agent. In the remainder of the description will be described more particularly the treatment of a thread with polyethylene terephthalate base drawn in contact with a cracking agent, as well as the new threads obtained. It is to be clearly understood that the invention is not limited to this type of thread, but also covers all those which, having a thermoplastic polymer base, answer to the definition given above.

The present invention therefore relates to a new thread with three-dimensional curl formed of continuous filaments made of thermoplastic synthetic material, each of them comprising, on the microscopic scale, alternating zones whose diameter increases and decreases gradually between at least two different mean values, and in which the zones of smaller diameter correspond to the zones having a higher index of crystallinity and a superior molecular structure, each filament having a large apparent volume, this thread being characterized in that it has an elasticity, superior by at least 25% to that of threads with three-dimensional curl, of the same chemical nature, embodied previously.

In the case of a polyethylene terephthalate thread previously drawn in contact with a cracking bath, the thread according to the invention has an elasticity comprised between 150% and 280% for titers comprised between 167 dtex (150 denier) and 22 dtex (20 denier).

The elasticity, also called curl elongation or foam effect, is determined by the following test:

There is prepared a testpiece ("flottillon") of thread, the weight of which corresponds to a total titer of 9240 decitex. This testpiece is immersed without tension in boiling water for about 10 minutes, which brings out the curl in the thread. After drying without tension and conditioning in normal atmosphere, we subject the testpiece to a load of 2100 grams for 2 minutes, and the length $L_1$ of the testpiece is measured. We then replace this load with a load of 16.8 grams and after one hour we read the new length $L_2$ of the testpiece. The elasticity is then given by the formula $(L_1/L_2) \times 100$. For titers equal to or less than 44 dtex, the total titer of the "flottillons" is 2640 dtex, and the respective loads are 600 grams and 4.8 grams.

The invention relates to a process for obtaining the threads described above. This process consists in subjecting to a false twist treatment a thread formed of thermoplastic synthetic filaments obtained by drawing in contact with a cracking agent, the said process being characterized in that, on the one hand, the level of twist imparted temporarily to the thread during the false twist treatment is much higher than that normally imparted, and in that, on the other hand, the heat treatment in the supertwisted state is carried out at a temperature higher than that utilized for the synthetic thermoplastic threads obtained by drawing with a cracking agent, but below the usual temperature utilized for standard threads. By "twist" and "usual temperature" we mean the twist and the temperature utilized during a treatment of false twist of a standard synthetic thermoplastic thread of the same chemical nature, that is to say a thread not drawn out in contact with a cracking agent, and whose filaments are uniform over their entire length.

Thus, it is well known that standard threads of polyethylene terephthalate are treated at a temperature comprised between 200° C. and 220° C., and preferably in the vicinity of 210° C., and that the maximum twist which they withstand, which varies with the titer, is, for example, in the vicinity of 5,000 turns/meter for 22 decitex thread, in the vicinity of 4,000 turns/meter for a thread of 50 decitex and 2,400 turns/meter for a thread of 167 decitex.

Preferably, according to the invention, there is applied a temporary twist greater by 20 to 30% than the twist normally imparted to a standard synthetic thread.

Furthermore, the heat-treatment temperature is lower by 20° C. to 50° C. than the mean temperature of fixation of standard synthetic threads, but it is higher by at least 10° ΣC. than the maximum temperature recommended in French Pat. No. 1,587,619 for the false twist treatment of a thread drawn in contact with a cracking agent. Thus, for threads of polyethylene terephthalate previously drawn in a cracking bath there is utilized according to the invention a temperature of fixation comprised between 160° C. and 190° C.

But the present invention will be better understood with the aid of the following example, given by way of indication but having no limiting character.

EXAMPLE

There is treated by false twist a thread of polyethylene terephthalate with a titer of 50 dtex/22 strands obtained by drawing in contact with a cracking bath comprised of a 25% solution of ethanol at ambient temperatures. The false twist spindle is driven with a speed of rotation of 110,000 rpm, and the heat treatment is applied by contact inside an electrically heated tube.

According to the invention, the temporary twist imparted to the thread is 5,100 turns/meter, that is to say, greater by about 25% than the maximum twist usually given to a thread of polyethylene terephthalate of the same titer, drawn or not in the presence of a cracking agent. The temperature in the fixing oven or tube is on the order of 190° C., the oven being 50 cm long. This temperature, lower by about 20° C. than that usually utilized for the false twist treatment of standard threads made of polyethylene terephthalate, is nevertheless higher by 30° C. than the maximum temperature recommended in French Pat. No. 1,587,619, which describes the treatment by false twist of a thread drawn in contact with a cracking agent.

By way of comparison we treat, on the same equipment apparatus and at the same rate, a standard thread under normal conditions and under the conditions of the invention, and a thread drawn in a cracking bath under normal conditions.

The results are assembled in the table on the following page:

| | I | II | III | IV * |
|---|---|---|---|---|
| Titer of thread (dtex) | 50 | 50 | 50 | 50 |
| Temp. of oven or tube (°C.) | 210 | 190 | 210 | 190 |
| Twist imparted by spindle (turns/meter) | 4000 | 5100 | 4000 | 5100 |
| Elasticity (%) | 180 | 210 | 180 | 230 |

-continued

| | I | II | III | IV * |
|---|---|---|---|---|
| Loss of tensile strength (%) | 7 to 8 | 35 | 5 to 6 | 8 to 10 |
| Breaks in production (per kg) | 0.3 | about 10 | 0.2 | less than 0.5 |

* Column I Standard polyester thread, treated under normal conditions
Column II Standard polyester thread, treated according to the invention
Column III Polyester thread drawn in a cracking bath, treated under normal conditions
Column IV Polyester thread drawn in a cracking bath, treated according to the invention This example clearly shows the advantages of the invention, which permits obtaining by false twist from thermoplastic synthetic threads previously drawn in contact with a cracking agent, threads which are much more elastic than those embodied previously, and without substantial increase in production breaks and without substantial reduction in the mechanical strength of the threads. This is particularly advantageous for threads with polyethylene terephthalate base which, up to this time, had insufficient elasticity for certain applications such as stockings, panty-hose and elastic fabrics and knits.

That which is claimed is:

1. A textile thread having three dimensional curl and formed of continuous filaments of polyethylene terephthalate, each filament comprising on a microscopic scale alternating zones whereof the diameter increases and decreases gradually between at least two different mean values, and in which the zones with smallest diameter correspond to the zones having a higher index of crystallinity and a superior molecular orientation, the thread having a large apparent volume and an elasticity of between about 150% and 280% for deniers between about 150 denier and 20 denier.

2. A process for obtaining a thread with three dimensional curl comprising the steps of drawing a thread formed of polyethylene terephthalate synthetic filaments while in contact with a cracking agent, thereafter false twisting the thread to a twist level which varies with thread size from between about 6,000 to 6,500 turns per meter for a 22 dtex thread, 4800 to 5200 turns per meter for 50 dtex thread, to about 2880 to 3120 turns per meter for 167 dtex thread, and heating the thread while in false twisted state to a temperature of between about 160° C and 190° C.

* * * * *

UNITED STATES PATENT OFFICE
CERTIFICATE OF CORRECTION

Patent No. 3,983,684 Dated October 5, 1976

Inventor(s) Jean Deltour

It is certified that error appears in the above-identified patent and that said Letters Patent are hereby corrected as shown below:

Column 1, line 49, delete "that" and insert --and--.

Column 2, line 65, "$10^{o}\Sigma C.$" should read --$10^{o}C.$--.

Signed and Sealed this

Fourteenth Day of December 1976

[SEAL]

*Attest:*

RUTH C. MASON
*Attesting Officer*

C. MARSHALL DANN
*Commissioner of Patents and Trademarks*